US006082654A

United States Patent [19]

Tholander et al.

[11] Patent Number: 6,082,654

[45] Date of Patent: Jul. 4, 2000

[54] YARN FEEDER

[75] Inventors: Lars Helge Gottfrid Tholander, Ulricehamn; Egon Johansson, Asunden; Thomas Bergman, Ulricehamn, all of Sweden

[73] Assignee: IRO AB, Ulricehamn, Sweden

[21] Appl. No.: 09/011,124

[22] PCT Filed: Jul. 10, 1996

[86] PCT No.: PCT/EP96/03020

§ 371 Date: Jul. 16, 1998

§ 102(e) Date: Jul. 16, 1998

[87] PCT Pub. No.: WO97/03907

PCT Pub. Date: Feb. 6, 1997

[30] Foreign Application Priority Data

Jul. 24, 1995 [DE] Germany ..... 195 26 948

[51] Int. Cl.[7] ..... B65H 51/20; D03D 47/36

[52] U.S. Cl. ..... 242/365.4; 139/452

[58] Field of Search ..... 242/365.4, 364.7, 242/364.8; 139/452

[56] References Cited

U.S. PATENT DOCUMENTS

| | | | |
|---|---|---|---|
| 4,429,723 | 2/1984 | Maroino | 139/452 |
| 4,926,912 | 5/1990 | Zenoni | 242/365.3 X |
| 5,123,455 | 6/1992 | Maina | 139/452 |
| 5,181,544 | 1/1993 | Deliuri | 139/452 |
| 5,316,051 | 5/1994 | Zenoni et al. | 242/365.4 X |
| 5,647,404 | 7/1997 | Maina et al. | 139/452 |
| 5,778,943 | 7/1998 | Tholander | 139/452 |

FOREIGN PATENT DOCUMENTS

| | | |
|---|---|---|
| 0 436 900 | 7/1991 | European Pat. Off. . |
| 0 446 447 | 9/1991 | European Pat. Off. . |
| 0 534 263 | 3/1993 | European Pat. Off. . |
| 0 567 045 | 10/1993 | European Pat. Off. . |
| 0 659 918 | 6/1995 | European Pat. Off. . |
| WO 94/20402 | 9/1994 | WIPO . |

*Primary Examiner*—Michael R. Mansen

*Attorney, Agent, or Firm*—Flynn, Thiel, Boutell & Tanis, P.C.

[57] ABSTRACT

A yarn feeder (F) including a holding device (H) for holding a yarn braking body in an extension arm (2, 2*a*) of a housing, a support body (6*a*) for a holder (5) of the yarn braking body (4) and a moving drive including a cylindrical piston (6*b*) which is movable in a cylinder (7) to move the yarn braking body (4) between a braking position and a gap position relative to a storage body (3) of the yarn feeder (F). The piston (6*b*) is arranged as an integrated guide element of the support body (6*a*) on the support body (6*a*). At least one guide nose (9) which engages into a guide track (10) fixed onto the extension arm is provided as a rotation preventing member on the piston and/or on the support body at a transverse distance from the piston axis (X).

20 Claims, 3 Drawing Sheets

YARN FEEDER

FIELD OF THE INVENTION

The present invention relates to a yarn feeder having a movable yarn braking body for braking yarn.

BACKGROUND OF THE INVENTION

In a yarn feeder which is known from EP 0 446 447 A1, the support body is a movable slide which is movable in the extension arm by means of a compressed-air/cylinder/piston unit. A spring is accommodated in the cylinder and acts on the piston in a direction opposite to the compressed-air action. The piston rod is coupled via a hinge to an adjusting screw which has fixed thereon the movable slide which is supported in the guide tracks of the extension arm and separated from the piston. The movable slide guides the holder of the yarn braking body which is adjustable by means of an adjusting screw relative to the movable slide. Great constructional efforts are required for guiding the movable slide in the extension arm and the holder on the movable slide. The strong soiling caused by depositing yarn material, the relatively great reactive forces of the support of the yarn braking body on the storage body, which slightly vibrates during operation, unavoidable wear in the various guide tracks, the multipart structure of the holding device and the necessity of an easy adjustability of the yarn braking body with an exactly reproducible braking position might lead to problems because of which the gap position and/or the braking position cannot be adjusted in the predetermined manner. Furthermore, the versatile holding device requires considerable constructional space.

It is the object of the present invention to provide a yarn feeder of the above-mentioned type in which the holding device is simple under manufacturing and assembling aspects and is only composed of a few parts and can guarantee the predetermined position of the yarn braking body in a reliable manner in the case of both frequent and rare adjusting operations.

SUMMARY OF THE INVENTION

This object is achieved by the yarn feeder of the invention which includes a guide on one of a piston and a support body and a guide track on an extension arm.

The holding device is simple under manufacturing (industrial scale manufacture) and assembling aspects and is robust during operation. It is only composed of a few parts and requires relatively litte constructional space (compact design). There is a very stable and exact guiding and positioning of the yarn braking body by the piston and by the guide nose which acts as a rotation preventing means, with the reaction forces being transmitted over a large surface and over a considerable length and with advantageous lever arms into the extension arm. The yarn braking body can be easily adjusted over long service lives. Predetermined positions of the yarn braking body are reliably reached at frequent and rare adjustment cycles. The holding device can be used in a universal manner and without any significant modifications in yarn feeders in which an automatic adjustment (action on the piston by compressed air) takes place for yarn threading and for changing the yarn braking body, and also in yarn feeders in which only a manual adjustment is desired. In the manually operated version the piston has a dominant guiding function, the guide portion of the piston in the cylinder being well protected against soiling, while the piston in the automatic version additionally assumes a drive function. It may be provided with one or several seals, if necessary. However, it is also possible to use material combinations with self-lubricating properties, e.g. a Teflon cover of the piston and/or the cylinder. The piston forms a unit with the support body with respect to stable guidance and mounting of the yarn braking body. Nevertheless, it might happen that the piston must be produced as a separate component and fixedly connected to the support body.

Production is simplified and there is an exact guiding of the yarn braking body thanks to an integral design of the cylinder in the extension arm.

The embodiment where an integrally molded member defines the piston and support body is advantageous from a manufacturing point of view. In particular for production on an industrial scale, injection molding is a suitable technique for ensuring highly accurate shapes and dimensions.

In the invention yarn feeder, the piston is guided by a spring to the respective braking position of the yarn braking body which has been adjusted with an adjusting screw. The holder need no longer be adjusted relative to the support body and guided during said operation, but takes the position which has been predetermined for it by the support body and which is defined by the position of the adjusting screw nut and can be varied, if desired. The spring can also be used for adjusting the braking position. As a positive side effect, the holder can rapidly be adjusted by hand relative to the spring without the adjusting screw having to be shifted at the same time. To save further parts, the spring and the adjusting screw nut could, however, be omitted in a simplified version and the adjusting screw could directly be screwed into the piston.

A stable, in particular broad, support is obtained by providing the piston and adjusting screw on one side and the guide nose on the other side of a central axial plane of the yarn braking body and extension arm. Constructional space is saved in radial direction, based on the axis of the storage body, and a compact design of the holding device is accomplished. Enough space is created for further components of the yarn feeder to be accommodated in the extension arm, for instance, sensors or the like.

The embodiment where the piston is tubular is constructionally simple.

By another feature of the invention, rotational locking and axial movability of the adjusting screw nut are achieved in a constructionally simple manner through the cross-section of the tubular section.

In the embodiment where the spring surrounds the adjusting screw, an advantageously long spring can be accommodated without additional constructional space being wasted. The long, centrally accommodated spring ensures that the yarn braking body is always reliably returned into the braking position again. The adjusting sleeve permits a manually effected movement of the yarn braking body, for instance for adjusting the gap position for threading a yarn or for replacing the yarn braking body.

The embodiment in which the yarn braking body is adjusted by rotating the adjusting sleeve, is constructionally simple, robust and reliable in function. The necessary rotary lift of the adjusting sleeve, the moving lift of the yarn braking body and the adjusting force can be predetermined by the shape and length of the guide groove. It is possible to mount the coupling element on the adjusting sleeve and to mold the guide groove into the rotary mount in the extension arm.

A uniform adjustment is possible where at least one end of the guide groove has a blocking section. The blocking section expediently provided for at one or both ends of the guide groove makes it possible to block the adjusting sleeve in such a manner that it is immovably held under the action of an axial force only. It is expedient to design the respective transition from the guide groove into the blocking section in a stepped manner, so that one can clearly feel at the turning handle of the adjusting sleeve that or whether the coupling element has entered into the blocking section.

The adjusting screw can easily be operated where a head of the adjusting screw has a turning knob with a rotary lock. The rotary lock permits a sensitively controlled rotation of the adjusting screw and prevents either the adjusting screw or the adjusting sleeve from rotating independently.

In the embodiment where the holder is pivotally supported, a pivotal movement of the yarn braking body is possible. The rotary pin is solidly supported.

An automatic adjustment of the yarn braking body into the gap position may be provided by the action of compressed air. The resetting operation is then carried out by the spring acting on the piston. The adjusting screw is not moved along with the adjusting movement because the adjusting screw nut is displaced in the piston. This contributes to a small motional resistance. In the case of a manually operable design the compressed-air supply enables the air displaced by the piston under the action of the spring to espace with little resistance.

The embodiment wherein an intercepting device is provided is especially expedient. Whenever the yarn braking body is fixed in the gap or exchange position and does not unintentionally return into the braking position again by mistake under the action of the spring or possibly even under the pneumatic actuation of the piston at a decreasing pressure.

The variant wherein the intercepting device comprises an engaging and disengaging element must be manipulated manually for engaging and/or disengaging the intercepting device, whereas in the embodiment of claim 16 it is solely the intercepting device which is engaged or released by the movement of the yarn braking body. It is only necessary to move the yarn braking body into the desired position (by hand or by means of a pneumatic actuation of the piston) in order to engage the intercepting device. A release of the intercepting device requires a slight further movement (by hand or by pneumatic actuation of the piston) before the spring will return the yarn braking body into the braking position.

BRIEF DESCRIPTION OF THE DRAWINGS

Embodiments of the subject matter of the invention shall now be explained with reference to the drawing, in which.

DETAILED DESCRIPTION

Figure 1:
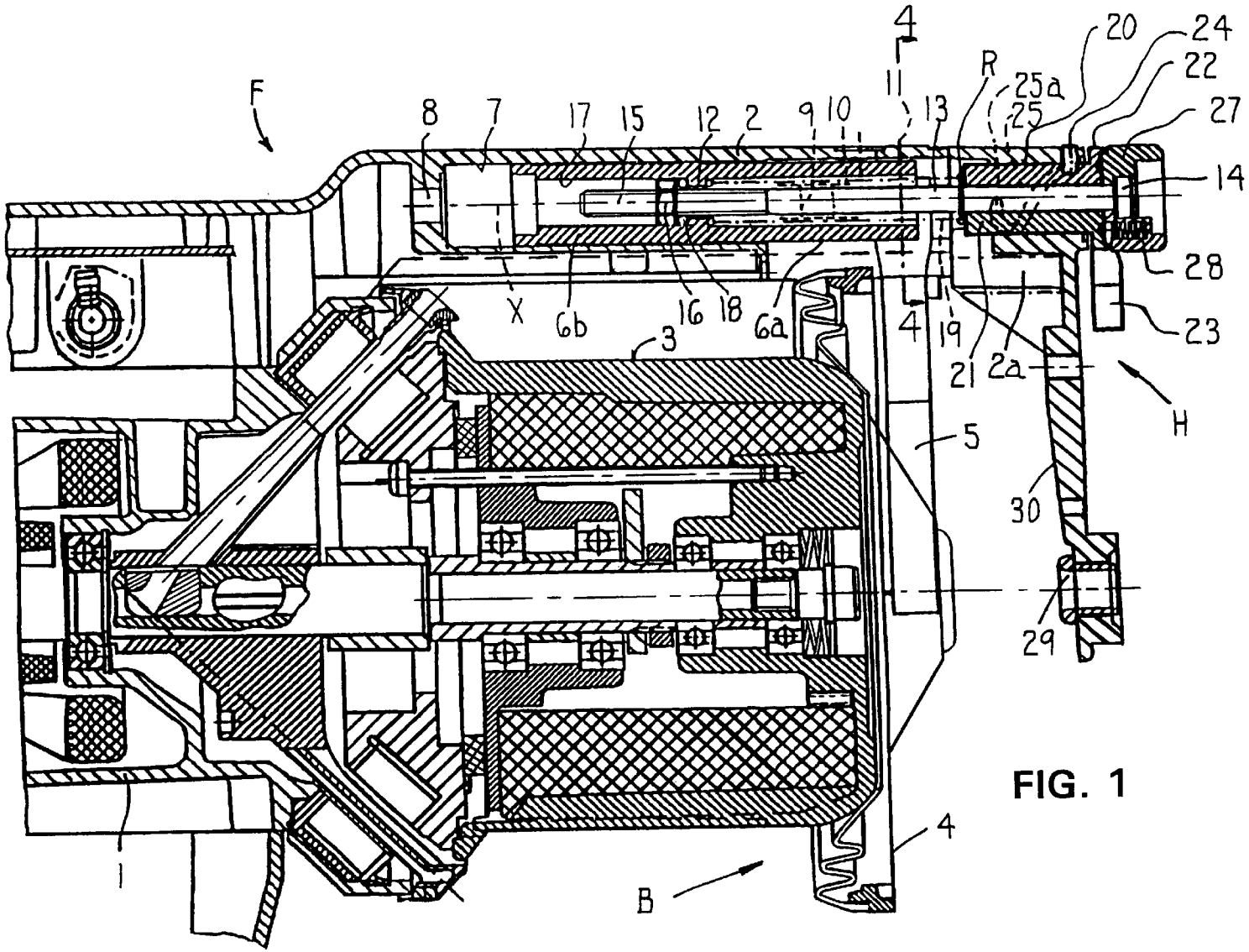
FIG. 1 is a longitudinal section through a yarn feeder comprising a holding device for a yarn braking body.

FIGS. 1–4 show two embodiments of yarn feeders F, each provided with a holding device H for a yarn braking body 4, wherein components which have the same function, but differ from one another in appearance and size are provided with the same reference numerals.

Figure 2:
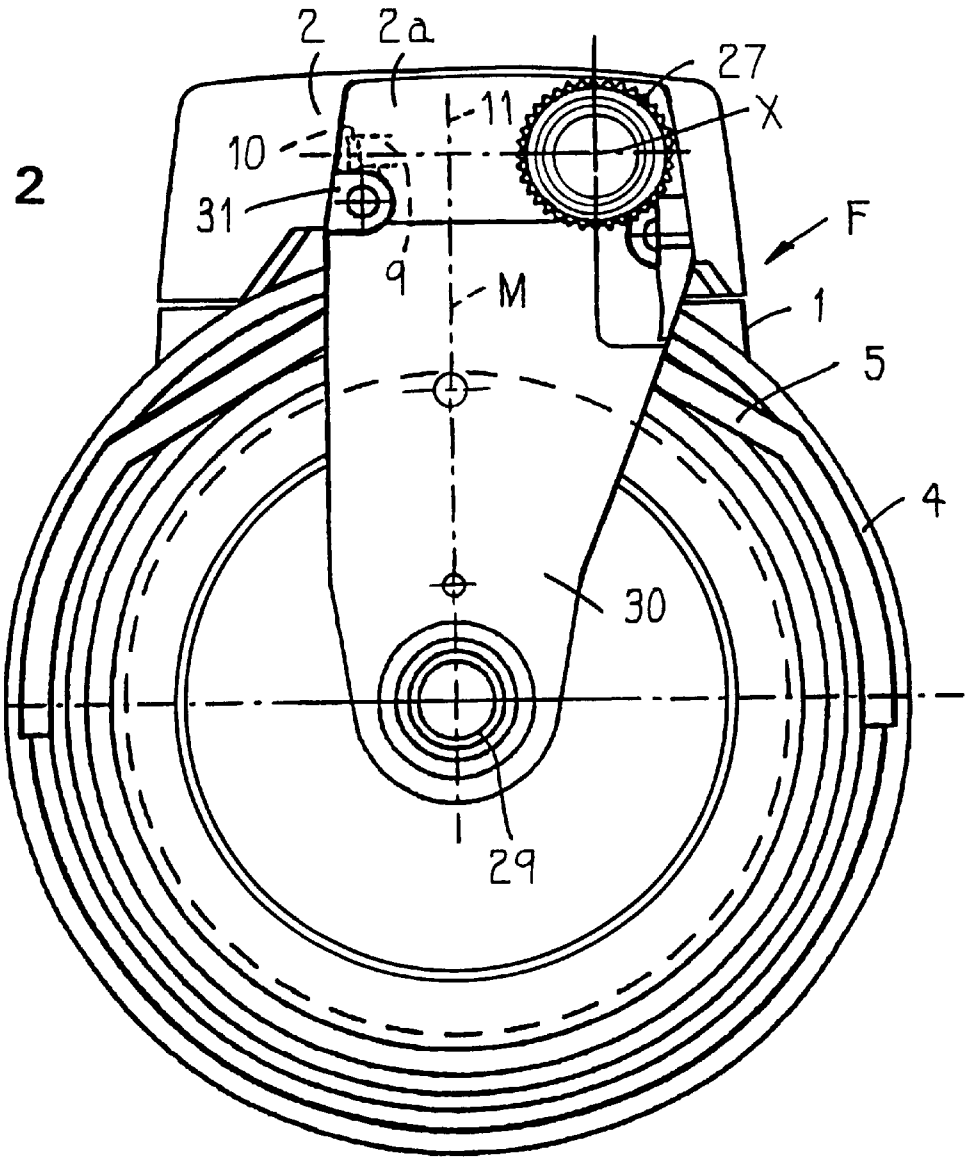
FIG. 2 is a front view of the yarn feeder of FIG. 1.

In the yarn feeder F of FIGS. 1 and 2, a housing 1 has arranged thereon an extension arm 2 with an extension arm end member 2*a* which extends along the outer circumference of a storage body 3 approximately in parallel with the longitudinal axis thereof beyond the storage body 3 and away from the housing 1. A yarn braking body 4 of an annular yarn brake B, which body is shown in its braking position in FIG. 1, cooperates in the customary manner with the storage body 3. The yarn braking body 4 is arranged, in a manner which is not shown in detail, on a holder 5 which (FIG. 2) is fork-shaped and supported in a support body 6*a*. The holder 5 is either fixedly connected to the support body 6*a* or (FIG. 1) is fixedly connected to the support body 6 in the longitudinal direction of extension arm 2, 2*a* and is pivotable about an axis 11 which is approximately radial relative to the storage body 3. The support body 6*a* has preferably integrally connected thereto a cylindrical piston 6*b* which projects from support body 6*a* towards housing 1 and is movably guided in a cylinder 7 integrally formed in extension arm 2, 2*a*. Cylinder 7 includes a compressed-air supply 8 to which a source of compressed air can be connected, if necessary.

A guide nose 9 which engages into a longitudinally extending guide 10 of the extension arm is provided on support body 6*a* and/or on piston 6*b* at a distance from piston axis X. It would also be possible to provide the guide nose 9 in the extension arm and to let the guide nose engage a guide of the support body 6*a* or of the piston 6*b*.

According to FIG. 2 the piston axis X is arranged at a side of a central plane M of the brake body 4 whereas the guide nose 9 and the longitudinal guide 10 are located at the other side of this central plane. This results in a guide which needs little constructional space in radial direction and is used for guiding the yarn braking body with advantageous lever arms relative to the central plane M.

The piston 6*b* has a tubular shape and is provided on the inside with a transverse wall which forms an axial stop 12. The transverse wall is provided with a bore which is passed through by a threaded section 15 of an adjusting screw 13. A tubular section 17 of the piston 6*b* is adapted with its cross-section to the circumferential configuration of an adjusting screw nut 16 which is secured against rotation in the tubular section 17, but made movable in the direction of piston axis X. A dampening and sealing O-ring 18 can be provided between the adjusting screw nut 16 and the axial stop 12. At the other side of the axial stop 12, there is supported a biased coil spring 19 which passes through the support body 6*a*, penetrates into piston 6*b* and rests in the embodiment of FIG. 1 with its other end on an adjusting sleeve 21 which supports the adjusting screw 14. The adjusting sleeve 21 is coaxially rotatable relative to piston axis X in a rotary mount 20 of the extension arm end member 2*a* and projects with an enlarged head portion 22 to the outside. A handle 23 for rotating or turning the adjusting sleeve 21 is provided on the head portion 22. A head 14 of the adjusting screw 13 is held in a turning knob 27 which is knurled and supported on the head portion 22 with a rotary lock 28 being interposed. The rotary lock 28 contains, for instance, a spring-loaded locking member which cooperates with locking recesses provided in the head portion 22.

The adjusting sleeve 21 is provided on its outer circumference with at least one inclined, for instance, thread-like guide groove 25 which is bordered at both ends and which is engaged by a coupling element 24 which is designed as a pin and disposed in the extension arm end member 2*a*. The guide groove 25 is expediently provided at both ends with blocking sections 25*a* which extend in rotational direction and which are respectively entered into by the coupling element 24 when an axial displacement of the adjusting sleeve 21 under an axial pressure is to be ruled out. The adjusting screw 13 is rotatably supported in the adjusting sleeve 21 and carries a retaining element R across which the reaction force of the yarn braking body 4 is transmitted to the adjusting sleeve 21 and from said sleeve to the coupling element 24 and the extension arm 2, 2*a*.

The extension arm end member 2*a* contains an enlarged wall 30 (FIG. 2) and a yarn eyelet 29 coaxial to the axis of the storage body. The end member 2*a* is secured at 31 to the extension arm 2.

Figures 3, 4:
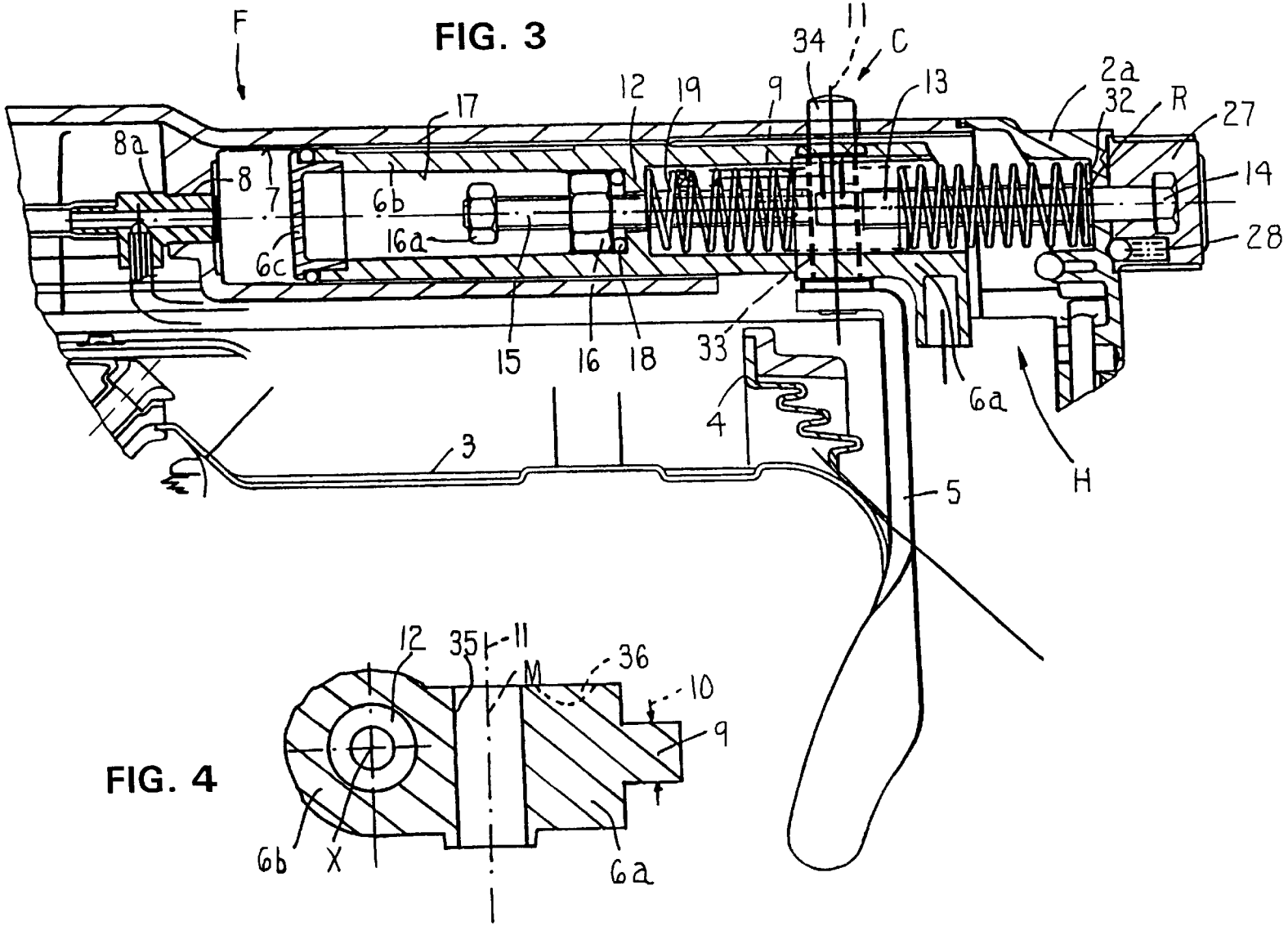
FIG. 3 is a longitudinal section through another embodiment of a yarn feeder.
FIG. 4 is a detail section in the plane of axis 11 in FIGS. 1 and 3.

The cross-section of the support body 6*a* with the piston 6*b* molded thereon and with the guide nose 9 can schematically be seen in FIG. 4. The piston 6*b* with the axial stop 12 is located at one side of axis 11 or the central plane M whereas the guide nose 9 is molded onto the opposite side.

A bore 35 serves to receive a pivot pin for pivotally mounting the holder 5 on support body 6*a*, as will later be explained with reference to FIG. 3.

In FIG. 1 the yarn braking body 5 is in the braking position in which it is axially pressed at a predetermined axial force onto the storage body 3. This position is either defined by the adjusting screw nut which is stopped on the axial stop 12 or, even more expediently, by the equilibrium of forces between the resilient reaction force of the yarn braking body 4 and the force of spring 19. When the axial stop 12 rests on the adjusting screw nut 16 in the position of FIG. 1, the piston 6*b* can be shifted further to the left by unscrewing the adjusting screw 13 by means of the turning knob 27 so as to increase the contact pressure of the yarn braking body. By contrast, when the adjusting screw 13 is tightened, the piston 6*b* is pulled further to the right via the adjusting screw nut 16 to reduce the contact pressure of the yarn braking body 4.

To move the yarn braking body 4 into a gap position with respect to the storage body 3, for instance, in order to thread a yarn or to replace the yarn braking body 4, the turning handle 22 is operated and the adjusting sleeve 21 is rotated so that thanks to the engagement of the coupling element 24 the adjusting sleeve 21 is pulled in FIG. 1 to the right, carrying along the adjusting screw 13 via the turning knob 27, with the adjusting screw 13, in turn, transferring the piston 6*b* with the support body 6*a* and the yarn braking body 4 into the gap position via the adjusting screw nut 16. The course of the guide groove 25 may be such that there will be an automatic locking action and any desired position of the yarn braking body 4 will be maintained automatically. However, it is also possible to rotate the adjusting sleeve 21 to such an extent, expediently over about half a rotation, that the coupling element 24 enters into the blocking section 25*a* at the left side. To return the yarn braking body 4 into the braking position the turning handle 23 is operated in the other direction, and the adjusting sleeve 21 is again moved into the position shown in FIG. 1.

The yarn feeder F according to FIG. 1 can be retrofitted for an automatic adjustment of the yarn braking body 4, if necessary. To this end the compressed-air supply 8 has connected thereto a source of compressed air which upon activation acts on piston 6*b* and displaces the piston 6*b* against the force of spring 19 up to the stop on the adjusting sleeve 21 at the most. The adjusting screw 13 maintains its position; the adjusting screw nut 16 is displaced in the tubular section 17. When the pressure applied to piston 6*b* is reduced, spring 19 will press the piston 6*b* and thus the support body 6*a* and the yarn braking body 4 back into the braking position again. To gain more space for the replacement of the yarn braking body, the adjusting sleeve 21 may also be rotated, as mentioned above.

The embodiment of the yarn feeder F according to FIG. 3 comprises a holding device H which may be of an automatic type (thanks to the action of compressed air on the piston 6*b* from the connection member 8*a* inserted into the compressed-air supply 8) and may also be designed for a manual adjustment (by a hand acting on holder 5). A cover cap 6*c* is additionally provided in piston 6*b*. A counter nut 16*a* is mouted on the adjusting screw 13. The adjusting screw 13 is fixed in the end member 2*a* of the extension arm 2 by means of the retaining element R (for instance a snap ring) in an axially immovable, but rotatable manner. The turning knob 27 cooperates with an end face of end member 2*a* which is provided at the right side and has molded therein locking recesses for the rotary lock 28. The spring 19 is supported with its right end directly on a counter-face 32 of the end member 2*a*. The holder 5 is pivotable with a pivot pin 33 in the support body 6*a* and about the axis 11.

In addition, there may be provided an intercepting device C for intercepting, against the force of spring 19, the support body 6*a* with the piston 6*b* in a gap or exchange position adjusted by action on the piston 6*b* or by pulling on holder 5. As for the intercepting device C, a manually operable engaging or disengaging element 34 can be seen which activates an intercepting element (not shown) which can be engaged against spring loading or disengaged under spring load and which grips behind a stop (not shown) of the support body 6*a*.

The intercepting device C is expediently designed such that it becomes operative by pressing on the engaging element 34 as soon as the yarn braking body 4 has reached the gap or exchange position. The intercepting element (not shown) is again disengaged by a renewed movement, either by action on the piston 6*b* or by manual pulling on holder 5, and the engaging and disengaging element 34 is again brought into the illustrated position.

The support body 6*a* with its integrally molded piston 6*b* of FIG. 3 is shown in FIG. 4 in a section in the plane of axis 11. The bore 35 serves to support the pivot pin 33. A shoulder for engaging the intercepting device C is drawn in broken line at 36. The guide nose 9 engages into the guide 10 of the extension arm 2 at the side of the central plane M opposite to the piston axis X so as to achieve lever arms which are as great as possible for guiding and supporting the yarn braking body 4.

Instead of the manually operable intercepting device C, an automatically acting intercepting device in the manner of a ratchet mechanism or an indexing means could be provided in the yarn feeder according to FIG. 3 (but also in the yarn feeder F according to FIG. 1), the automatically acting intercepting device becoming operative and retaining the support body 6*a* in the gap or exchange position of the yarn braking body 4 whenever the unit consisting of support body 6*a* and piston 6*b* has been adjusted to a correspondingly great extent. To release the automatic intercepting device, the unit consisting of support body 6*a* and piston 6*b* must be further moved in the same direction of movement, for instance, by renewed action on piston 6*b* or by pulling on holder 5 in FIG. 3 to the right in order to release the intercepting device automatically. In such a case the yarn braking body 4 will return automatically into the braking position again under the action of spring 19.

In the embodiment of FIG. 1, the spring 19 and the adjusting screw nut 16 could be omitted, provided the adjusting screw 13 is directly screwed with its threaded section 15 into the transverse wall of the piston 6*b* which forms the axial stop 12. In such a case, however, it would no longer be possible to adjust the yarn braking body 4 by simply pulling on holder 5 and the piston 6*b* could also no longer be acted upon pneumatically.

The unit consisting of support body 6*a* and piston 6*b* is technically advantageous under manufacturing aspects because it is possible with relatively small efforts to achieve a neat engagement between cylinder 7 and piston 6*b* and an anti-rotational locking substantially without any play due to the engagement of the guide nose 9 into the guide 10 of the extension arm. The cooperation between the cylindrical piston 6*b* and the also cylindrical cylinder 7, which is integrally molded into the extension arm 2, can be controlled easily, just like the cooperation between guide nose 9 and guide 10, i.e. without any substantial wear and above all without any danger arising from malfunctions caused by depositing impurities, such as yarn material, dust and lint which are bound to be encountered in such a yarn feeder to a great degree. Furthermore, the assembly is simple, since it is only the piston which has to be introduced into the cylinder, and the guide nose into the guide. In the embodiment of FIG. 1, the adjusting sleeve 21 with the adjusting screw 13 and the screwed-on piston 6*b* with the support body 6*a* can be prefabricated. The holder 5 is then mounted through an opening from above in the extension arm 2 on support body 6*a*.

We claim:

1. In a yarn feeder comprising a storage body for storing a yarn thereon, a housing, and a holding device having an annular yarn braking body which surrounds said storage body for braking said yarn during removal from said storage drum, said holding device being arranged in an extension arm of said housing and comprising a support body which is linearly movably guided in said extension arm for supporting a holder of said yarn braking body, said yarn feeder further including a support-body moving drive having a cylindrical piston which is movable in a cylinder along a piston axis to move said yarn braking body between a braking position and at least one gap position, said gap position being adjustable by said moving drive, comprising the improvement wherein said piston is arranged on said support body and forms an integrated guide element of said support body, a fixed guide track being provided on said extension arm wherein said guide track is disposed a transverse distance from said piston axis, one of said piston and said support body including at least one guide nose which engages into said guide track and prevents rotation of said support body about said piston axis.

2. The yarn feeder according to claim 1, wherein said cylinder is integrally formed in said extension arm.

3. The yarn feeder according to claim 1, wherein said support body and said piston are defined by an integrally molded member.

4. The yarn feeder according to claim 3, wherein said molded member is formed of metal or plastics.

5. The yarn feeder according to claim 1, wherein said holder is fixedly mounted on said support body in an adjusting direction, an adjusting screw being provided which is rotatable in said extension arm and supported in the adjusting direction relative to said extension arm and which engages into said piston, said piston including an axial stop which is fixed thereon, an adjusting screw nut being provided which is movable relative to said piston and is secured against rotation in said piston, a spring being provided which acts on and biases said adjusting screw nut towards said axial stop.

6. The yarn feeder according to claim 5, wherein said piston and said adjusting screw are arranged at one side and said guide nose at the other side of a central axial plane of said yarn braking body and said extension arm.

7. The yarn feeder according to claim 6, wherein said piston is made tubular and provided with a transverse wall which forms said axial stop, said spring penetrating from behind into said piston and being supported on said transverse wall.

8. The yarn feeder according to claim 5, wherein a tubular section of said piston is provided as a space of movement for said adjusting screw, said tubular section having a cross-section which is adapted to the circumferential configuration on said adjusting screw nut.

9. The yarn feeder according to claim 5, wherein said spring surrounds said adjusting screw and is supported at an end facing away from said axial stop, said spring being supported directly in said extension arm.

10. The yarn feeder according to claim 5, wherein said spring surrounds said adjusting screw and is supported at an end facing away from said axial stop, said spring being supported on an adjusting sleeve which is axially and manually movable in said extension arm and in which said adjusting screw is supported in an axially immovable manner.

11. The yarn feeder according to claim 10, wherein said adjusting sleeve is arranged in a rotary mount of said extension arm which is coaxial to said piston axis, said adjusting sleeve including a turning handle which is accessible from outside of said yarn feeder and is provided in the area of said rotary mount with an axially defined guide groove, said guide groove being inclined relative to the rotational direction, a coupling element being provided which engages into said guide groove and is retained in said extension arm such that turning of said turning handle axially displaces said adjusting sleeve.

12. The yarn feeder according to claim 11, wherein said guide groove is provided at at least one end with the blocking section extending approximately in the rotational direction to prevent axial displacement of said adjusting sleeve.

13. The yarn feeder according to claim 5, wherein a head of said adjusting screw is inserted into a turning nut which is seated at the free end of said extension arm directly, said turning nut including a rotary lock which prevents rotation thereof.

14. The yarn feeder according to claim 5, wherein a head of said adjusting screw is inserted into a turning nut which is seated on a head portion of said adjusting sleeve, said turning nut including a rotary lock which prevents rotation thereof.

15. The yarn feeder according to claim 5, wherein said extension arm has arranged therein an intersecting device defining said gap position of said yarn braking body for intersecting said yarn braking body adjusted against said spring, said intersecting device acting on one of said piston and said support body against the operative direction of said spring.

16. The yarn feeder according to claim 15, wherein said intersecting device comprises a manually operable engaging and disengaging element which is accessible from outside of said extension arm.

17. The yarn feeder according to claim 16, wherein said intersecting device is spring-loaded.

18. The yarn feeder according to claim 15, wherein said intersecting device can automatically be engaged and disengaged by the adjusting motion of said yarn braking body.

19. The yarn feeder according to claim 1, wherein said holder of said yarn braking body is patentably supported in said support body with a rotary pin located in a central axial plane of said yarn braking body and said extension arm.

20. The yarn feeder according to claim 1, wherein said cylinder comprises a compressed-air supply.

* * * * *